US005460363A

United States Patent [19]

Tomer

[11] Patent Number: 5,460,363

[45] Date of Patent: Oct. 24, 1995

[54] SPORTS UTILITY ACCESSORY

[76] Inventor: Rex F. Tomer, 707 N. Duquoin St., Benton, Ill. 62812

[21] Appl. No.: 218,900

[22] Filed: Mar. 28, 1994

[51] Int. Cl.[6] ..... A63B 69/40

[52] U.S. Cl. ..... 273/26 A; 383/3

[58] Field of Search ..... 273/26 R, 26 A; 383/4

[56] References Cited

U.S. PATENT DOCUMENTS

| | | | |
|---|---|---|---|
| 954,840 | 4/1910 | Wiedemann | 383/4 |
| 1,479,903 | 1/1924 | Erland | 383/4 |
| 1,511,430 | 10/1924 | Schonberg . | |
| 2,254,986 | 9/1941 | Ziel | 273/26 |
| 2,532,778 | 12/1950 | Mintzes | 383/4 |
| 2,873,969 | 2/1959 | Ziel | 273/26 |
| 2,908,020 | 10/1959 | Barton | 383/4 |
| 3,425,539 | 2/1969 | Mach | 383/4 |
| 3,489,194 | 1/1970 | Hoover | 383/4 |
| 4,118,028 | 10/1978 | Larkin | 273/26 |
| 4,620,396 | 11/1986 | Bjorntwedt | 383/4 |
| 4,723,300 | 2/1988 | Rosalind | 383/4 |
| 5,031,733 | 7/1991 | Chang | 383/4 |
| 5,110,219 | 5/1992 | Lopes | 383/4 |

FOREIGN PATENT DOCUMENTS 527667 10/1940 United Kingdom .

*Primary Examiner*—Theatrice Brown
*Attorney, Agent, or Firm*—John R. Flanagan

[57] ABSTRACT

A multi-functional sports utility accessory includes a flexible panel made of substantially inelastic resilient sheet material and a plurality of different elements attached to the flexible panel for converting the flexible panel to perform the multiple diverse funtions of an equipment carrying bag, a sports practice aid, and an equipment holder. The different converting elements are provided at various locations on the flexible panel, for example, on opposite edges thereof, arranged about the periphery thereof and applied on one or both opposite sides thereof. The different converting elements include a pair of handles attached at opposite edges of the flexible panel to use the accessory as the carrying bag, strips of complementary hook and loop material arranged about the periphery of the flexible panel to use the accessory as the equipment holder, a plurality of hooks attached adjacent to the periphery of the flexible panel to use the flexible panel in folded condition as an equipment holding pocket or in unfolded flat condition as a practice aid, and a symbol applied or imprinted on one or both of the opposite faces of the flexible panel to provide the accessory as target when the accessory is used as a practice aid.

13 Claims, 2 Drawing Sheets

SPORTS UTILITY ACCESSORY

BACKGROUND OF THE INVENTION

1. Field of the Invention

The present invention generally relates to organizing and coordinating the multiplicity of activities associated with coaching a sports team, for instance, such activities as carrying equipment to and from practices or games, providing practice aids like pitching targets to assist pitchers in warming up while the coach warms up the infield by hitting ground balls, and gathering and maintaining the equipment out of the way when not being used. More particularly, the present invention relates to a sports utility accessory that can perform the multiple functions of an equipment carrying bag, a sports practice aid and an equipment holder, all in one.

2. Description of the Prior Art

Most people who have coached a Little League Baseball boys or girls team knows the problems with bringing all the equipment needed and trying to keep the children from getting hurt during the practice, warm up before the game or during the game. Without the use of an oversized carrying bag, the coach usually has to make several trips to get all the equipment from the car to the dugout. Once the coach is out in the field warming up the team, the starting catcher, wearing protective pads, is out there with the coach, and a volunteer, usually a parent, or the second string catcher, who usually doesn't have any protective pads on, is over to the side warming up the pitcher. Any young pitcher will usually be wild with some of his or her pitches and the volunteer who is trying to help, could get hit several times and end up getting hurt. Furthermore, without the use of expensive equipment holders, such as helmet and baseball bat holders, the baseball equipment is usually thrown into the dugout comer on the ground during the game and that's a dangerous area for children. They can trip over the equipment and sprain an ankle while entering or exiting the dugout.

Consequently, a need exists for a simple and effective way to overcome the aforementioned problems, and thereby facilitate carrying all the baseball equipment to the dugout, warming up and practicing the pitchers and holding the baseball equipment out of the way during the game.

SUMMARY OF THE INVENTION

The present invention combines a pitching target, equipment holder and carrying bag into a multi-functional sports utility accessory which is designed to satisfy the aforementioned need. The sports utility accessory provides a simple and effective device for carrying, using and storing sports equipment at separate times during both practice sessions as well as games. For example, when used during baseball season, the accessory facilitates carrying the baseball equipment, providing a practice aid, such as a pitching target, and holding and storing equipment out of the way during the game which, in turn, provides a better environment for players, reducing the potential hazards which can cause injuries.

Accordingly, the present invention is directed to a sports utility accessory which comprises: (a) a flexible panel; and (b) a plurality of different means attached to the flexible panel for converting the flexible panel to perform the muliple diverse functions of an equipment carrying bag, a sports practice aid, and an equipment holder. The flexible panel is made of a substantially inelastic resilient flexible sheet of material and has a generally rectangular configuration. The different converting means are provided at various locations on the flexible panel, for example, on opposite edges thereof, arranged about the periphery therof and applied on one or both opposite sides thereof.

More particularly, a first of the converting means is a pair of handles attached at opposite edges of the flexible panel to use the accessory as the carrying bag. A second of the converting means is a fastener arrangement, such as a zipper closure or a pair of complementary strips of hook and loop material, arranged about the periphery of the flexable panel to use the accessory as the equipment holder. A third of the converting means is a plurality of attaching elements, such as hooks, attached adjacent to the periphery of the flexible panel to use the accessory in folded condition as an equipment holding pocket or in unfolded flat condition as a practice aid. A fourth of the converting means is a symbol applied or imprinted on one or both of the opposite faces of the flexible panel to provide the accessory as target when the accessory is used as a practice aid.

These and other features and advantages of the present invention will become apparent to those skilled in the art upon the reading of the following detailed description when taken in conjunction with the drawings wherein there is shown and described an illustrative embodiment of the invention.

BRIEF DESCRIPTION OF THE DRAWINGS

In the following detailed descriptions reference will be made to the attached drawing in which.

DETAILED DESCRIPTION OF THE INVENTION

Figure 1:
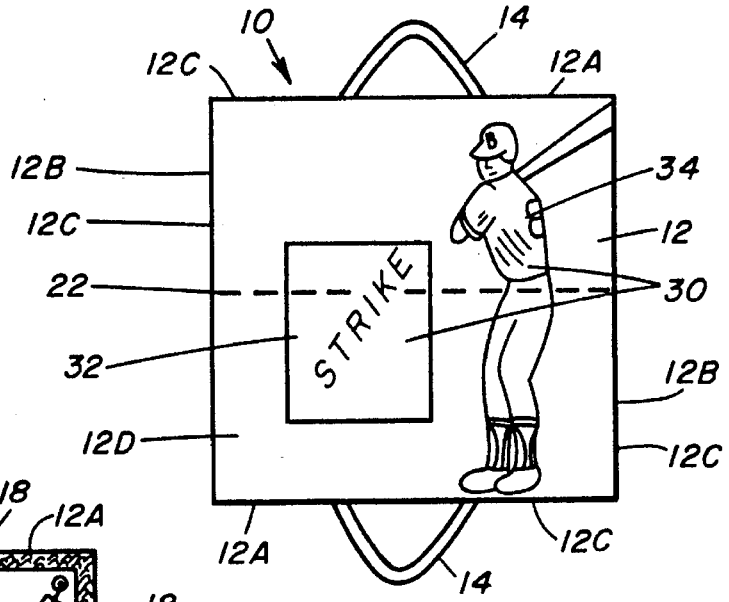
FIG. 1 is a front view of an embodiment of a sports utility accessory of the present invention shown opened up with a batter and strike zone painted on the front.
Figure 2:
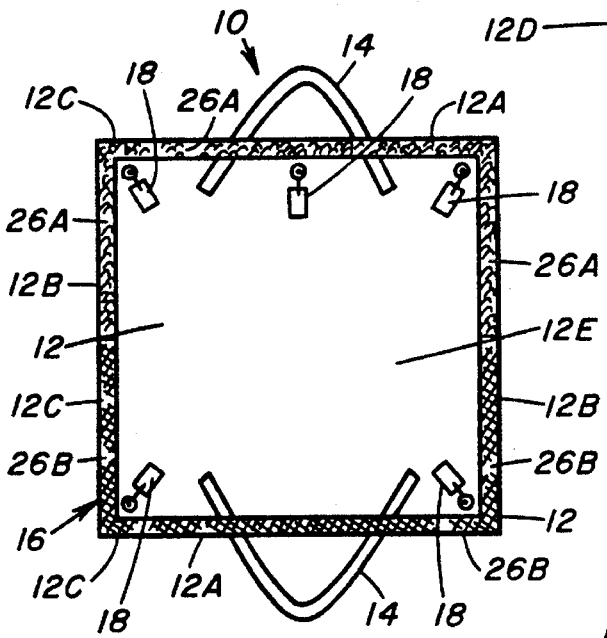
FIG. 2 is a back view of the embodiment of a sports utility accessory of the present invention shown with attaching means along the borders so that openings and closings are accomplished.

Referring to the drawings and particularly to FIGS. 1 and 2, there is illustrated a sports utility accessory of the present invention, generally designated 10. Basically, the sports utility accessory 10 includes a flexible panel 12 and a plurality of different elements 14, 16, 18, 20 being attached to the flexible panel 12, adapting it to easily and readily converted to perform multiple diverse functions, for example, first as an equipment carrying bag, second, as a sports practice aid, and third, an equipment holder. To effectively serve these multiple diverse funtions, the flexible panel 12 is preferably made of a substantially inelastic resilient sheet of material, such as a durable plastic material, and has a generally rectangular configuration with pairs of opposite side egdes 12A, 12B. As will be described hereinafter, the different converting means 14, 16, 18, 20 are provided at various locations on the flexible panel 12, for example, on a pair of the opposite edges 12A of the panel 12, about and adjacent to the periphery 12C of the flexible panel 12, and applied on one or both opposite faces 12D, 12E thereof.

Figure 5:
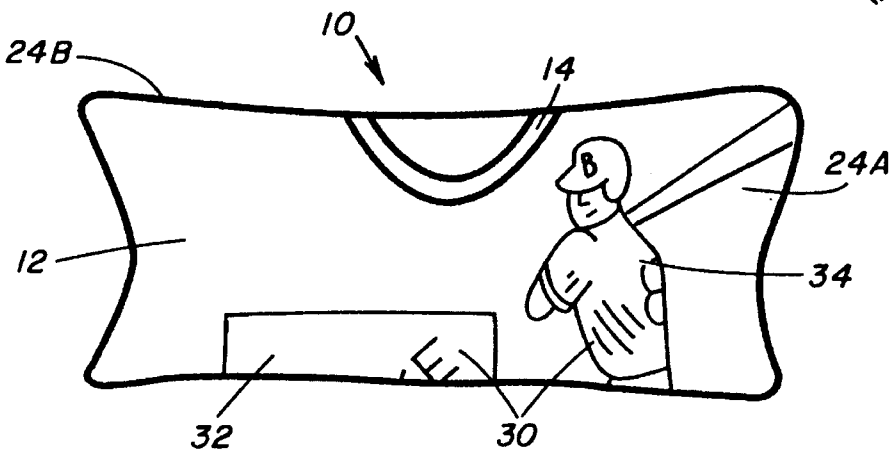
FIG. 5 is a side view of the sports utility accessory of FIG. 1 being fastened together to form a duffel bag with handles for carrying.

More particularly, a first of the converting means 14 of the accessory 10 is a pair of handles 14 attached at the pair of opposite side edges 12A of the flexible panel 12 in order to use the flexible panel 12 as the equipment carrying bag. The handles 14 preferably have loop configurations and are attached at generally midway locations along the pair of opposite side edges 12A of the flexible panel 12. The flexible panel is adapted to be folded along dashed line 22, as shown in FIG. 1, to provide opposing side portions 24A, 24B of substantially equal size as depicted in FIG. 5. The pair of handles 14 adapt the folded flexible panel 12 to be carried from above while holding the various items of sports equipment in a wedged relationship between the opposite side portions 24A, 24B.

A second of the converting means 16 of the accessory 10 is an arrangement of spaced apart fasteners 26A, 261t. The spaced fasteners can be a zipper closure (not shown but more preferably is a pair of complementary strips 26A, 26B of hook and loop material, being known commercially under the Velcro trademark, arranged about the periphery 12C of the flexible-panel 12 to use the accessory as the equipment holder. More particularly, the spaced fasteners 26A, 26B are attached to and extend along corresponding peripheries of the folded side portions 24A, 24B for converting the flexible panel 12 into an enclosed duffel-type bag for use in the above-described equipment carrying mode.

Figure 3:
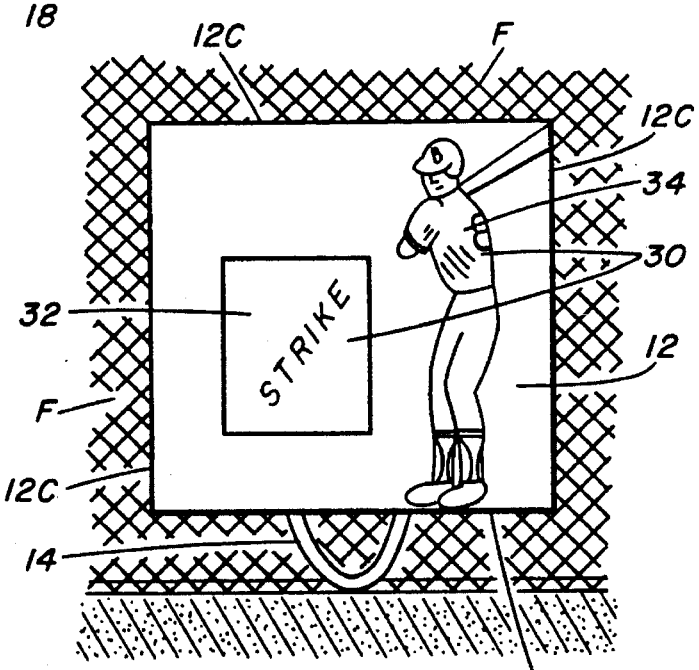
FIG. 3 is a front view of the sports utility accessory of FIG. 1 being hung on a chain link fence to be used as a pitching target.
Figure 4:
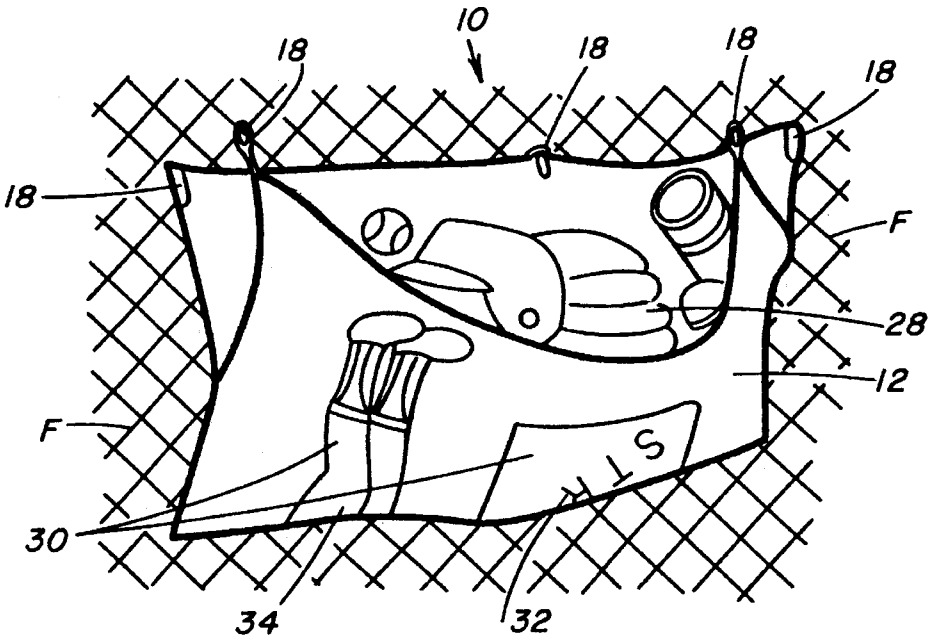
FIG. 4 is a front view of the sports utility accessory of FIG. 1 being hung up on a chain link fence and hooked to form a pocket to hold baseball equipment.

A third of the converting means 18 is a plurality of attaching elements, such as hooks 18, attached adjacent to the periphery 12C of the panel 12 to use the accessory in the folded condition as an equipment holding pocket or in unfolded flat condition as a practice aid, as shown respectively in FIGS. 3 and 4. The hooks 18 are attached to the panel 12 by means of a piece of material being looped through one end of the hook and sewn directly to the panel 12, so that the hook will be able to support the weight of the accessory 10 and its contents without tearing. The attaching hooks 18 adapt the flexible panel 12 to be attached and hung on a vertical structure, such as a chain link fence F or a dugout wall, either as an unfolded flat panel 12, as seen in FIG. 3, providing a practice target, such as for pitching or kicking, or as a folded holder, as seen in FIG. 4, providing a large pocket 28 that can be used to store sports equipment. The hooks 18 are preferably configured to be easily and quickly secured on and removed from the vertical structure F.

A fourth of the converting means 20 is a symbol 30 applied or imprinted on one or both of the opposite faces 12D, 12E of the flexible panel 12 to provide the accessory 10 as a target when the accessory is used as a practice aid. The symbol 30 can take many different shapes and forms, for example, a circle, a rectangular box 32 shown in FIG. 3, a figure of a person 34, or a team insignia.

It is thought that the present invention and it various advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A sports utility accessory, comprising:

(a) a flexible panel; and (b) a plurality of different means attached to said flexible panel for converting said flexible panel to perform the multiple diverse functions of an equipment carrying bag and a sports practice aid;

(c) a first of said converting means being handle means attached to said flexible panel for adapting said flexible panel to be folded into opposing side portions and carried while holding various items of sports equipment in a wedged condition between said opposite side portions;

(d) a second of said converting means being a plurality of attaching elements attached to said flexible panel in spaced apart relation from one another at locations adjacent to and about a periphery of said flexible panel, said attaching elements adapting said flexible panel to be attached and hung on a vertical structure as an unfolded flat panel for use as said sports practice aid;

(e) a third of said converting means being a sports target symbol applied on at least one of a pair of opposite faces of said flexible panel to provide a target for players using said accessory as said sports practice aid when hung as the unfolded flat panel.

2. The accessory of claim 1 wherein said flexible panel has a generally rectangular configuration.

3. The accessory of claim 1 wherein said handle means is loop shaped and being attached to said side portions of said flexible panel.

4. The accessory of claim 1 wherein said handles are attached at substantially midway locations along said side portions of said flexible panel.

5. The accessory of claim 1 wherein said attaching elements are hooks.

6. A sports utility accessory, comprising:

(a) a flexible panel; and (b) a plurality of different means attached to said flexible panel for converting said flexible panel to perform the multiple diverse functions of a sports practice aid and an equipment holder;

(c) a first of said converting means being a plurality of hooks attached to said flexible panel in spaced apart relation from one another at locations adjacent to and about a periphery of said flexible panel, said hooks adapting said flexible panel to be attached and hung on a vertical structure as an unfolded flat panel for use as said sports practice aid or to be folded and attached and hung on the vertical structure as a folded equipment holder providing a pocket for storing sports equipment;

(d) a second of said converting means being a sports target symbol applied on at least one of a pair of opposite faces of said flexible panel to provide a target for players using said accessory as said sports practice aid when hung as the unfolded flat panel.

7. The accessory of claim 6 wherein said flexible panel has a generally rectangular configuration.

8. The accessory of claim 6 wherein a third of said converting means is a fastener arrangement attached to and extending about a periphery of said flexible panel for converting said panel into an enclosed bag by folding said flexible panel into a pair of side portions so as to bring corresponding peripheral portions thereof together.

9. The accessory of claim 8 wherein said fastener arrangment includes strips of complementary hook and loop material.

10. A sport utility accessory, comprising:

(a) a flexible panel; and (b) a plurality of different means attached to said flexible panel for converting said flexible panel to perform the multiple diverse functions of an equipment carrying bag, a sports practice aid, and an equipment holder;

(c) a first of said converting means being a fastener arrangement in the form of strips of complementary hook and loop material attached to and extending about a periphery of said flexible panel for converting said panel into an enclosed folded bag by folding said flexible panel into a pair of opposite portions so as to bring corresponding peripheral portions thereof together;

(d) a second of said converting means being a plurality of hooks attached to said flexible panel in spaced apart relation from one another at locations adjacent to and about a periphery of said flexible panel, said hooks adapting said flexible panel to be attached and hung on a vertical structure as an unfolded flat panel for use as said sports practice aid or to be folded and attached and hung on the vertical structure as a folded equipment holder providing a pocket for storing sports equipment.

11. The accessory of claim 10 wherein said panel is made of substantially inelastic resilient sheet of material and has a generally rectangular configuration.

12. The accessory of claim 10 wherein a third of said converting means is a pair of handles adapting said flexible panel to be folded into opposing side portions and carried while holding various items of sports equipment in a wedged condition between said opposite side portions.

13. The accessory of claim 10 wherein a third of said converting means is a sports target symbol applied on at least one of a pair of opposite faces of said flexible panel to provide a sports target for players using said accessory as said sports practice aid when hung as the unfolded flat panel.

* * * * *